US006467535B1

(12) United States Patent
Shembekar et al.

(10) Patent No.: US 6,467,535 B1
(45) Date of Patent: Oct. 22, 2002

(54) EXTRUDED MICROCHANNEL HEAT EXCHANGER

(75) Inventors: Ajit R. Shembekar, Farmington Hills; Peter R. Gawthrop, Royal Oak, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/941,459

(22) Filed: Aug. 29, 2001

(51) Int. Cl.[7] ..... F28D 7/10

(52) U.S. Cl. ..... 165/140; 165/165; 165/174; 165/177

(58) Field of Search ..... 165/174, 177, 165/183, 140, 165; 29/890.053

(56) References Cited

U.S. PATENT DOCUMENTS

| | | | | | |
|---|---|---|---|---|---|
| 1,701,617 | A | * | 2/1929 | Hyfe | 165/177 |
| 3,110,754 | A | * | 11/1963 | Witort et al. | 165/177 |
| 3,537,485 | A | * | 11/1970 | March | 138/111 |
| 3,777,502 | A | * | 12/1973 | Michie, III et al. | 165/154 |
| 4,242,877 | A | | 1/1981 | Geerkens | |
| 4,438,809 | A | | 3/1984 | Papis | |
| 5,009,262 | A | | 4/1991 | Halstead et al. | |
| 5,174,373 | A | * | 12/1992 | Shinmura | 165/176 |
| 5,400,853 | A | * | 3/1995 | Wolters | 165/174 |
| 5,544,703 | A | | 8/1996 | Joel et al. | |
| 5,704,423 | A | * | 1/1998 | Letrange | 165/183 |
| 5,765,393 | A | | 6/1998 | Shlak et al. | |
| 5,898,995 | A | * | 5/1999 | Ghodbane | 29/890.045 |
| 5,927,388 | A | | 7/1999 | Blangetti et al. | |
| 5,941,303 | A | | 8/1999 | Gowan et al. | |
| 6,098,706 | A | | 8/2000 | Urch | |

* cited by examiner

*Primary Examiner*—Henry Bennett
*Assistant Examiner*—Terrell McKinnon
(74) *Attorney, Agent, or Firm*—Brinks Hofer Gilson & Lione

(57) ABSTRACT

A fluid-to-fluid heat exchanger comprising a body having channels side-to-side and extending end-to-end, said channels being capable of directing fluids in alternate and opposite (counter-flow) directions in the body, the body being crimped adjacent to said ends so that the fluid is fully enclosed in said body. Fluid entrance and exit openings in the body so that the alternate channels within the body can enable the fluid to achieve the desired conclusion of the heat exchanger, and manifolds secured to said heat exchanger so that they communicate with alternate channels within the heat exchanger, and some channels are not of the same cross sectional size so that some channels can move more fluid in a given time and are smaller than other channels.

7 Claims, 2 Drawing Sheets

EXTRUDED MICROCHANNEL HEAT EXCHANGER

TECHNICAL FIELD OF THE INVENTION

The purpose of this invention is to improve the vehicle heat transfer capabilities of a heat exchanger, while simplifying the production methods and costs, and reducing the part size and weight.

BACKGROUND OF THE INVENTION

These are all major advantages over the prior technologies. Additionally, this invention does not require the heat exchanger to be orientation- or location-specific for vehicle applications. Prior technology requires the heat exchanger in a vehicle to be substantially in the vertical plane and located in an air stream to affect a transfer.

The vehicle heat exchangers are cross-flow designs with the fluids transported in bulk fashion through tubes, single cavity tube or with microchannels with external fins for air cooling such as a vehicle radiator and condenser. The fluids flow is typically arranged in a cross-flow design. For liquid-to-liquid heat exchangers, shell-and-tube, plate-fin or concentric heat exchangers are used.

SUMMARY OF THE INVENTION

In this invention, fluid-to-fluid heat exchangers for automotive applications are designed such that the fluids flow through microchannels in alternate and opposite (counter-flow) directions. Any number of fluids can be cooled or heated simultaneously with either a single coolant, such as a water-glycol mixture, or multiple coolants.

The heat exchanger is designed as an extrusion with microchannels with alternate channels dimensions optimized for the given fluid. A certain length of this extruded tube is then cut off and its ends crimped shut so that channels inside are fully enclosed. Next, fluid entrance and exit holes are drilled into the tube walls in a predetermined manner. Finally, manifolds are brazed on the tube walls such that they communicate with alternate channels within the extruded tube.

Other general and more specific aspects of the invention will be set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DETAILED DESCRIPTION OF THE PREFERRED EMBODIMENT

The following description of the preferred embodiment of the invention is not intended to limit the scope of the invention to list a single embodiment, but rather to enable any person skilled in the art to make and use the invention.

Figure 1:
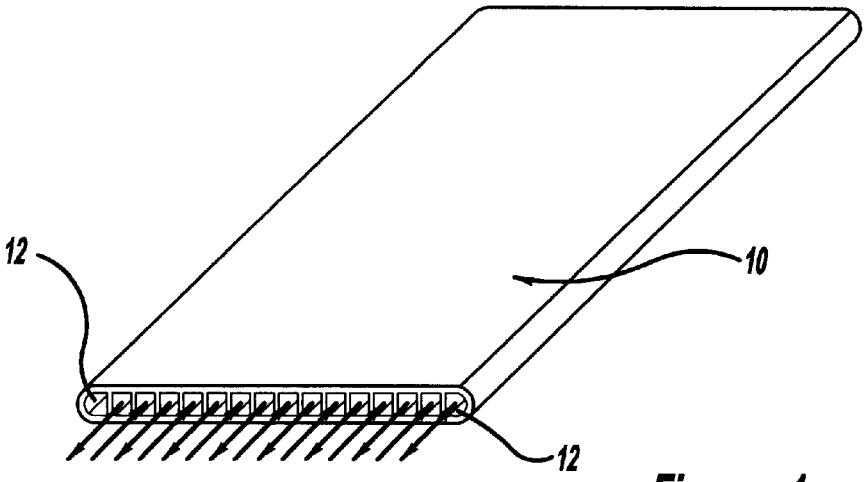
FIG. 1 is a perspective view of a side-by-side channel members for cooled and heated various multiple fluids heated or cooled with single or multiple coolants.

A fluid-to-fluid heat exchanger 10 embodying what is an extrusion with microchannels 11 as shown in FIG. 1. In FIG. 1, it is shown fluid A to be cooled/heated on one side of the body 12 and fluid B to be cooled/heated on the other side. The coolant is in half of the channels 12 with either A or B fluids on both sides.

Thus, FIG. 1 represents the underlying fact that an extrusion with microchannels 11 can cool or heat fluid, where the other fluids in channels 11 is moving in a direction relative to the first fluids, which are to be cooled or heated.

Figure 2:
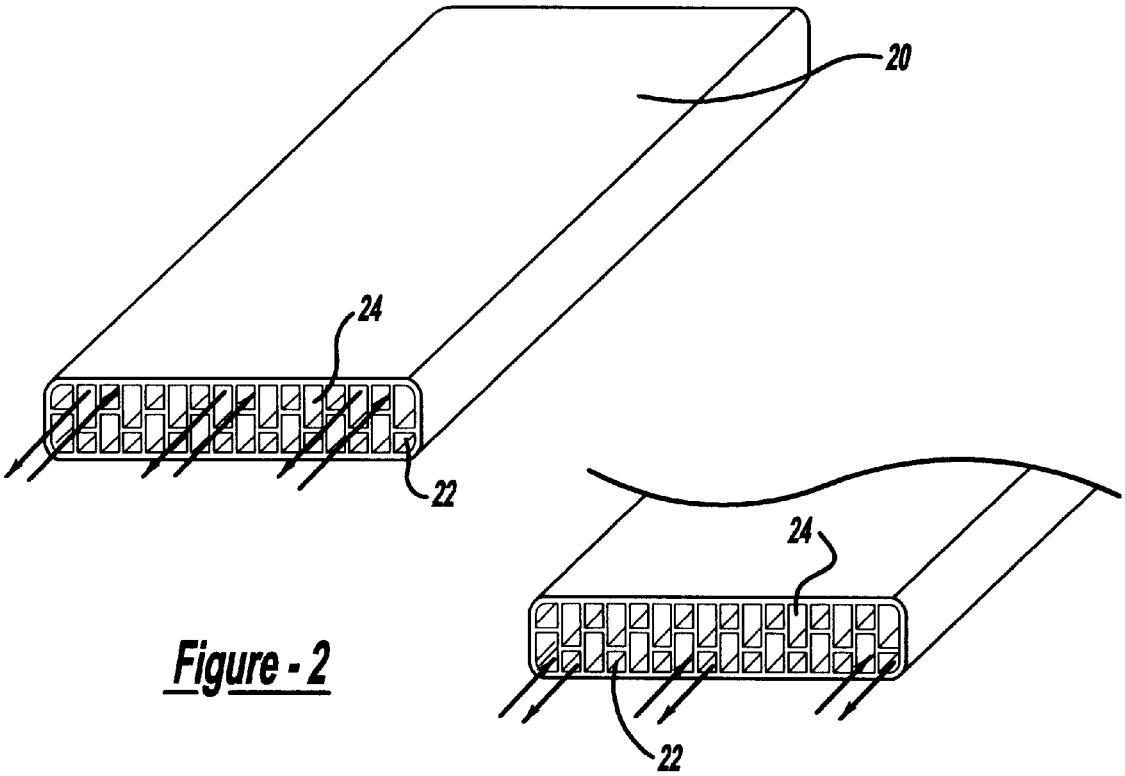
FIG. 2 shows a similar heat or cold exchanger optimized for given fluids.

FIG. 2 shows the channel dimensions are optimized for a given fluid. This goal is achieved by making microchannels 22 and 24 with the capacity of the channel 24 being twice in terms of moving a given fluid to another given fluid. The heat exchanger 20 is constructed as an extrusion with microchannels with alternate channel dimensions optimized for the given fluid.

Figure 3:
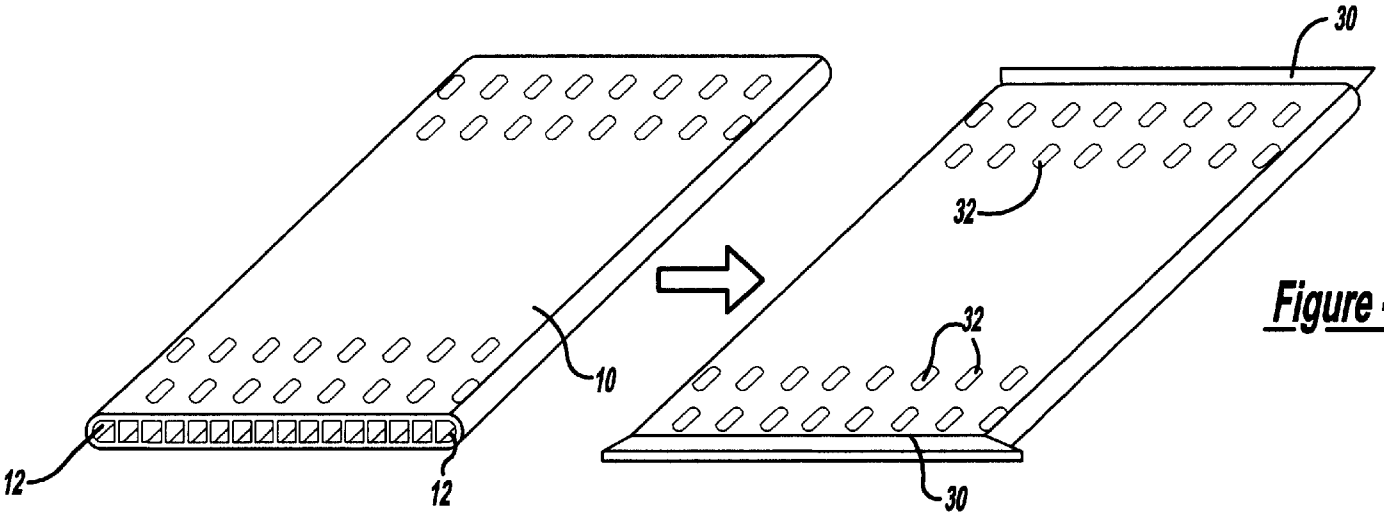
FIG. 3 is a heat exchanger like the heat exchangers shown in FIGS. 1 and 2 wherein a heat exchanger is drilled and the ends crimped for use in a completed heat exchanger.

FIG. 3 shows that the ends of the body 12 crimped to form seams 30 that seal the ends of the body 10.

Next, fluid entrance and exit holes 32 are drilled into the body 10 adjacent the seams.

Figure 4:
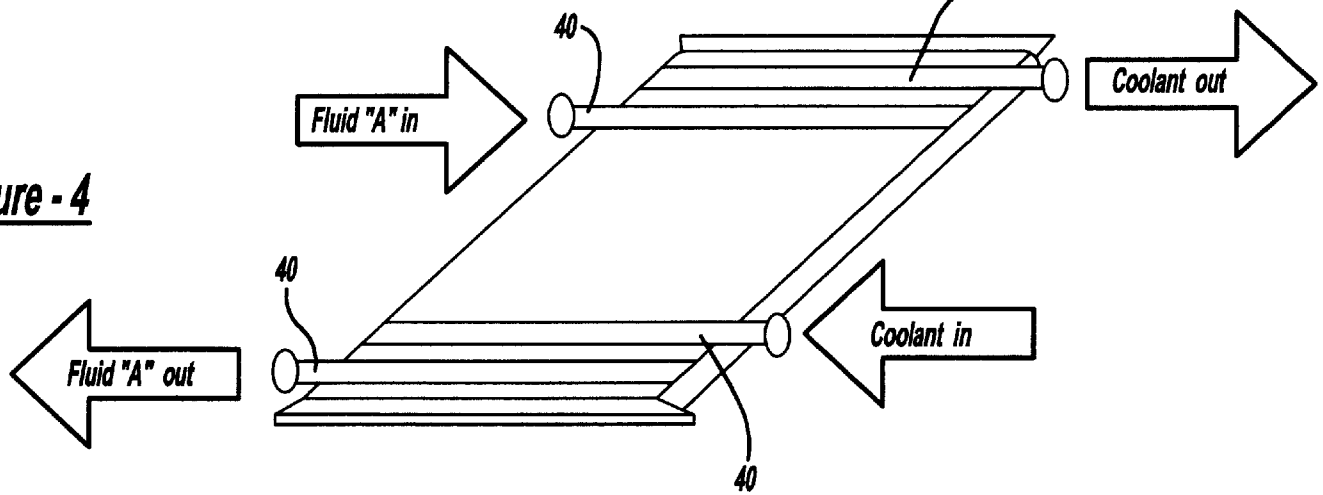
FIG. 4 shows the final completed heat exchanger with manifolds.

Finally, manifolds 40 are brazed on the body 10, the manifolds having drilled holes (not shown) lining up with the holes 30 shown in FIG. 3. Thus, the manifolds 40 can communicate with alternate channels within the extruded tube as shown in FIG. 4.

It is believed that the fluid-to-fluid heat exchanger using microchannels embodying principles that have been described and illustrated herein can improve heat exchanger performance and durability.

The foregoing discussion discloses and describes two preferred embodiments of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology, which has been used, is intended to be in the nature of words of description rather than of limitation.

What is claimed is:

1. A fluid-to-fluid counter-flow heat exchanger comprising an extruded body having outer walls and multiple micro-channels side-to-side and extending between two opposite ends of said body, said micro-channels being capable of directing a first and a second fluid in alternate and opposite directions in said body, both of said body ends being crimped so that said first and second fluids are fully enclosed in said body, and said body having multiple entrance and exit openings in said body outer walls for said first and second fluids so that a first set of alternate micro-channels within the body receives said first fluid and a second set of alternate said micro-channels receives said second fluid, whereby said heat exchanger provides heat exchange between said first and second fluids.

2. A fluid-to-fluid heat exchanger according to claim 1 further comprising manifolds secured to said heat exchanger outer walls so that they communicate with said first and second sets of alternate micro-channels within said heat exchanger.

3. A fluid-to-fluid heat exchanger according to claim 1 wherein said micro-channels are not of the same cross sectional size so that said micro-channels of said first set are smaller than said micro-channels of said second set.

4. A fluid-to-fluid heat exchanger according to claim 1 wherein said entrance and exit openings are located adjacent said opposite ends.

5. A fluid-to-fluid heat exchanger according to claim 2 wherein said manifolds are secured to said body walls by brazing.

6. A fluid-to-fluid heat exchanger according to claim 1 wherein said body defines a thickness between said walls and each of said first and second sets of micro-channels extend fully across said thickness.

7. A fluid-to-fluid heat exchanger according to claim 1 wherein said body defines a thickness between said walls and said first and said second set of micro-channels are overlaid to combine to extend fully across said thickness.

* * * * *